US005077924A

United States Patent [19]

Yamaguchi

[11] Patent Number: 5,077,924

[45] Date of Patent: Jan. 7, 1992

[54] BULLETIN SUSPENDING MECHANISM IN BULLETIN DEVICE

[75] Inventor: Kinichiro Yamaguchi, Tokyo, Japan

[73] Assignee: Artpanel Consultant Co., Ltd., Tokyo, Japan

[21] Appl. No.: 575,122

[22] Filed: Aug. 30, 1990

[30] Foreign Application Priority Data

Jun. 19, 1990 [JP] Japan ..... 2-65234[U]

[51] Int. Cl.[5] ..... G09F 17/00

[52] U.S. Cl. ..... 40/603; 40/574; 38/102.91; 160/378

[58] Field of Search ..... 40/603, 604, 574; 38/102, 102.1, 102.91; 160/378, 404

[56] References Cited

U.S. PATENT DOCUMENTS

| | | | |
|---|---|---|---|
| 1,361,624 | 12/1920 | Schmidt | 38/102.91 |
| 2,429,256 | 10/1947 | Block | 38/102.91 |
| 4,097,968 | 7/1978 | Pikus | 38/102.91 |
| 4,317,302 | 3/1982 | Van de Linde | 40/156 |
| 4,452,000 | 6/1984 | Gandy | 40/603 |
| 4,674,213 | 6/1987 | Keithley | 40/603 |
| 4,674,214 | 6/1987 | Gandy | 40/603 |
| 4,937,961 | 7/1990 | Gandy et al. | 40/574 |

*Primary Examiner*—Kenneth J. Dorner
*Assistant Examiner*—Brian K. Green
*Attorney, Agent, or Firm*—Klauber & Jackson

[57] ABSTRACT

According to the present invention, in a bulletin device for indication or decoration in station yards, underground passages, buildings, exhibitions, etc., having a parting portion which constitutes a front face of a device frame and which is formed for opening and closing motion or which can be removable, a suitable number of retaining means are mounted inside a horizontal mounting portion hidden on a rear side of the parting portion, the retaining means being each mounted with a bolt so as to be adjustable in movement inwards and outwards, and a bulletin is connected to the retaining means and suspended in a tensed state within the device frame by turning the head of each said bolt positioned outside the horizontal mounting portion. The degree of stretching of the bulletin can be adjusted freely. Besides, in mounting or replacing a bulletin, the bulletin can be suspended quickly and easily in a tensed state and to a desired degree of stretching.

5 Claims, 5 Drawing Sheets

BULLETIN SUSPENDING MECHANISM IN BULLETIN DEVICE

BACKGROUND OF THE INVENTION

1. Industrial Utilization Field

The present invention relates to a bulletin device for indication or decoration in station yards, underground passages, buildings, exhibitions, etc. and more particularly to a device capable of freely adjusting the degree of stretching of a thin film- or sheet-like flexible bulletin and also capable of performing the mounting and replacement of such bulletin rapidly and easily in a suspended and stretched state to desired degree of tension.

2. Prior Art

For example, reference is here made to the bulletin device proposed in Japanese Utility Model Publication No. 25113/77 by the present inventor (see FIG. 12).

According to the construction of this proposed bulletin device, a pair of front and rear retaining receptacles 51 are formed inside a device frame 50, and a hook plate 52 is retained by the retaining receptacles 51 removably. A large number of hooks 53 are formed and arranged suitably on the surface of the plate 52, and springs 55 from which is suspended a bulletin 54 are suspended from the hooks 53.

Even in the cases of bulletins 54 having holes 56 for engagement with the springs 55 in different numbers and positions, each bulletin 54 can be suspended in a well-balanced stretched state by suspending the springs 55 from nearby hooks 53. Replacement of the bulletin 54 can be done easily by opening a parting piece 57 and disengaging the hook plate 52 with the springs 55 suspended therefrom from the front side of the device frame 50.

In the bulletin device of the above construction there are used a large number of springs for suspending the bulletin without looseness. But for adjusting the degree of stretching of the bulletin it is absolutely necessary to either increase or decrease the number of springs or make replacement with a spring having a desired pulling force. Besides, the spring mounting and removing operations are time-consuming troublesome operations because such springs are handled one by one.

Further, since the retaining receptacles of the hook plate are hidden by the rear side of the engaging portion which supports the parting piece for opening and closing motion, the hook plate mounting and removing operations are performed by groping for the retaining receptacles which are hidden by the rear side of the engaging portion and so not seen. Thus, the working efficiency is poor.

SUMMARY OF THE INVENTION

According to the bulletin suspending mechanism in a bulletin device of the present invention, in a bulletin device wherein a parting portion which constitutes the front face of a device frame is formed for opening and closing motion or removably, an appropriate number of retaining means are mounted so as to be movable inwards and outwards using bolts, along the inside of a horizontal mounting portion which is hidden by the rear side of the said parting portion, and a bulletin which is in a connected state to the retaining means is suspended in a stretched state within the device frame by turning the heads of the said bolts outside the horizontal mounting portion.

The construction just mentioned above affords the following effects. The stretched state of the bulletin can be adjusted freely by the bolts through the retaining means, so the bulletin can be suspended to an appropriate degree of stretching without looseness according to its weight, tensile strength and size.

In the mounting and replacement of the bulletin, by either opening or removing the parting portion and mounting the retaining means with bolts to the inside of the horizontal mounting portion under direct looking at the horizontal mounting portion which is exposed to the front face of the device frame, it is possible to quickly suspend the bulletin which is in a connected state to the retaining means.

The present invention is also characteristic in that the aforementioned bolts are each mounted removably forwards and backwards with respect to a cutout slot formed in the front edge of the horizontal mounting portion. This construction affords the following effect.

The mounting and replacement of a bulletin can be done from the front side of the device frame in a connected state of the retaining means and the bolts to the bulletin and the retaining means, respectively, whereby the saving of labor can be attained, and this is useful in the case where there is a limit on the working time.

Moreover, the present invention is characterized in that a protuberant portion is formed along the front edge of the outer surface of the horizontal mounting portion. This construction affords the following effect.

Since the forward movement of the bolt head is prevented by the protuberant portion, the bulletin can be held in its suspended state unless the bolts are loosened and caused to get over the protuberant portion artificially.

Further, the present invention is characterized in that the aforementioned bolts can be mounted so that they each can be taken out and put in inwards and outwards with respect to a through-hole formed in the horizontal mounting portion.

The present invention is further characteristic in that the foregoing retaining means each comprise a retaining member provided on the front side and a retaining plate provided on the front side, the retaining member having a projecting portion along the front edge of its outer surface and retaining holes along the inner edge of its front face, the retaining plate having on its outer edge a semiarcuately projecting, engaging flange capable of getting over and engaging the said projecting portion, the retaining plate also having engaging pawls formed on the inner edge thereof, the retaining pawls projecting through a bulletin engageably with the said retaining holes, whereby the bulletin can be sandwiched removably between the retaining member and the retaining plate. This construction brings about the following effect.

By merely putting the retaining member on a bulletin from the back side of the bulletin and pushing the retaining plate from the front side, the retaining flange comes into engagement with the projecting portion and the retaining pawls pierce the bulletin and come into engagement with the retaining holes. Thus, the bulletin can be mounted in a connected state by such a simple nipping operation, while by merely pulling out the retaining pawls from the retaining holes they can be disengaged from the bulletin, and hence the bulletin mounting and removing operations can be done efficiently.

Moreover, the present invention is characterized in that the retaining pawls are a little inclined outwards with respect to a horizontal plane. this brings about the following effect.

Since the retaining pawls are held while being deformed into a horizontal posture from its original obliquely outward posture, a repulsive force is created at the retaining pawls, which repulsive force strengthens the degree of engagement of the retaining pawls with the retaining holes and ensures the engaged state between the retaining flange and the projecting portion. Consequently, there can be attained satisfactory state of connection with the bulletin.

Further, the present invention is characterized in that the retaining means each comprise a retaining member provided on the rear side and a retaining plate provided on the front side, the retaining plate capable of being mounted to the retaining member with bolts, whereby a bulletin can be sandwiched removably between the retaining member and the retaining plate. This brings about the following effect.

The state of connection between the retaining means and the bulletin can be made firm.

BRIEF DESCRIPTION OF THE DRAWINGS

FIGS. 1 to 7 illustrate a bulletin device according to a first embodiment of the present invention, of which:

FIG. 1 is a front view;

FIG. 2 is an enlarged vertical sectional view taken along line II—II in FIG. 1;

FIG. 3 is a partial enlarged sectional view taken along line III—III in FIG. 1;

FIG. 4 is an enlarged front view of a corner portion, partially broken away;

FIG. 5 is a partial enlarged perspective view with principal portions shown in an exploded state;

FIG. 6 is an enlarged exploded sectional view of a retaining means; and

FIG. 7 is an enlarged cross sectional view of a retaining member.

DETAILED DESCRIPTION OF THE INVENTION

Figure 1:
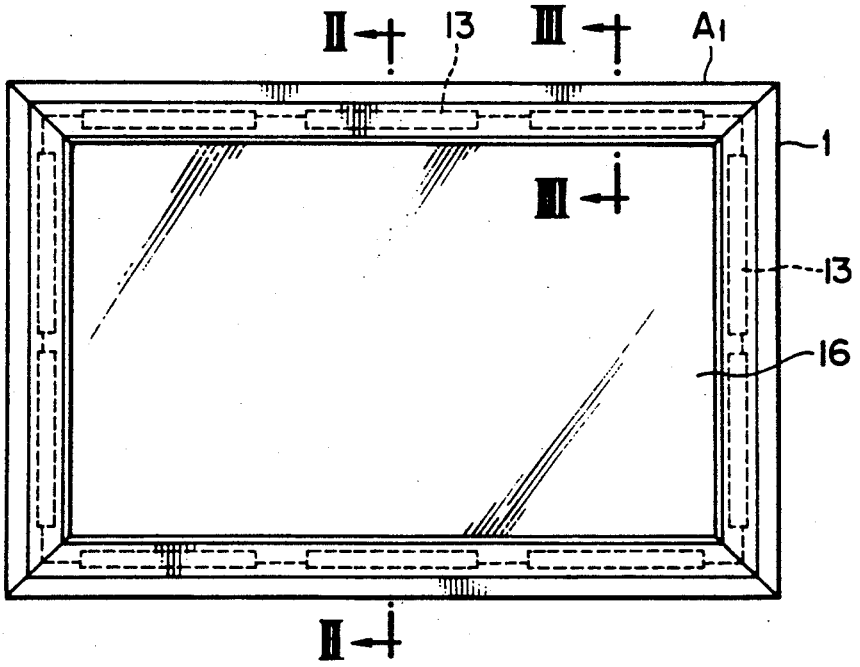
Figure 3:
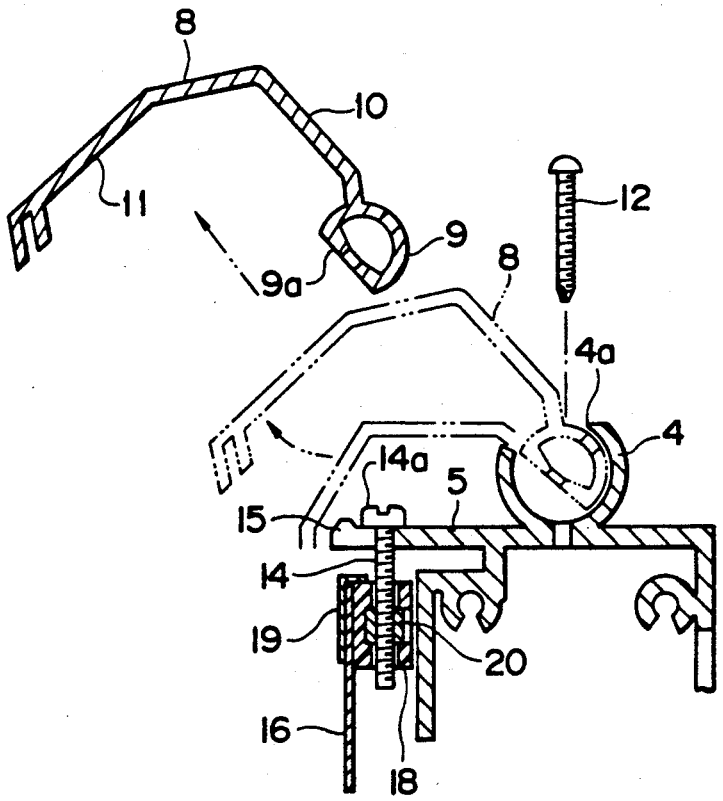
Figure 2:
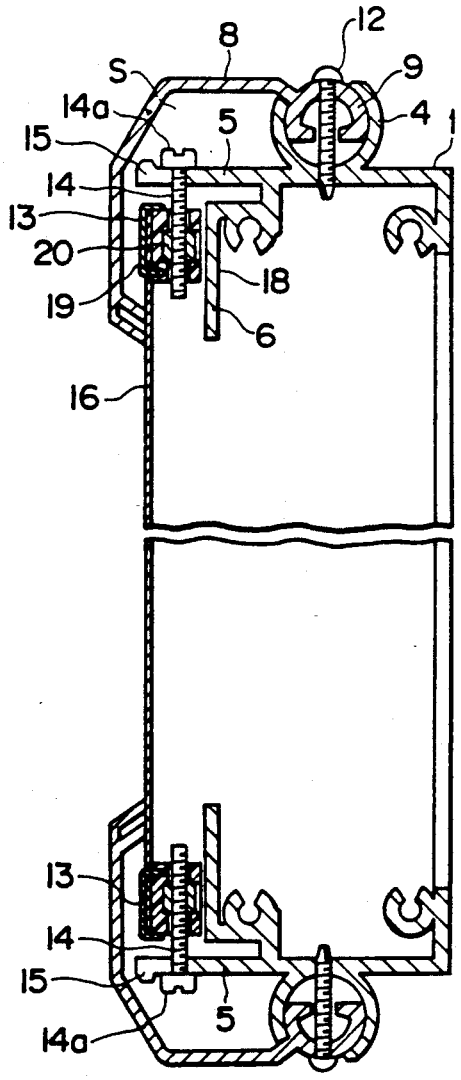
Figure 4:
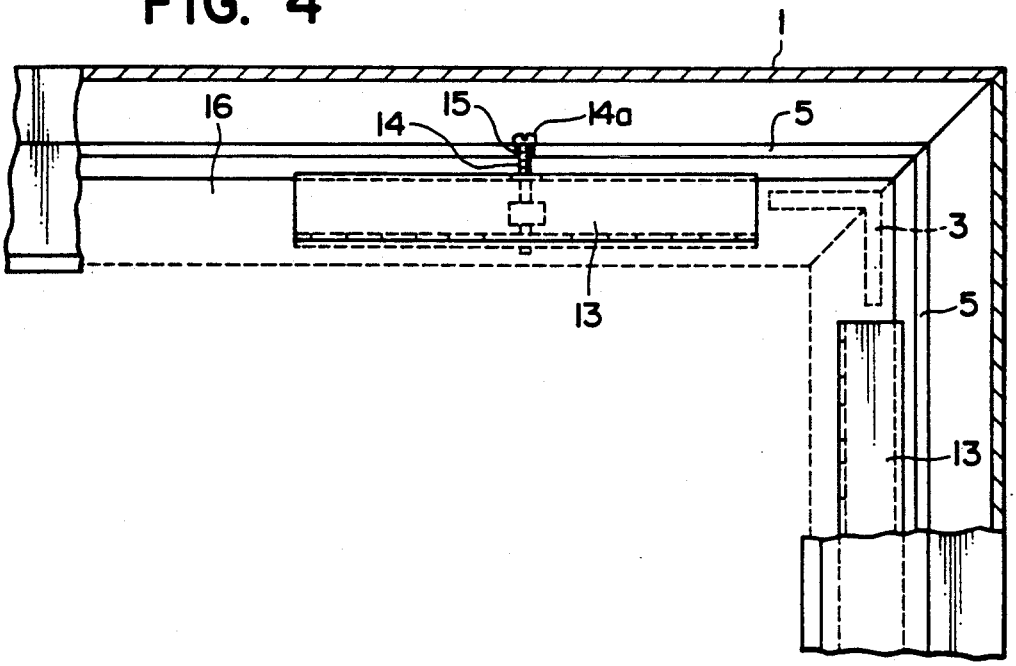
Figure 5:
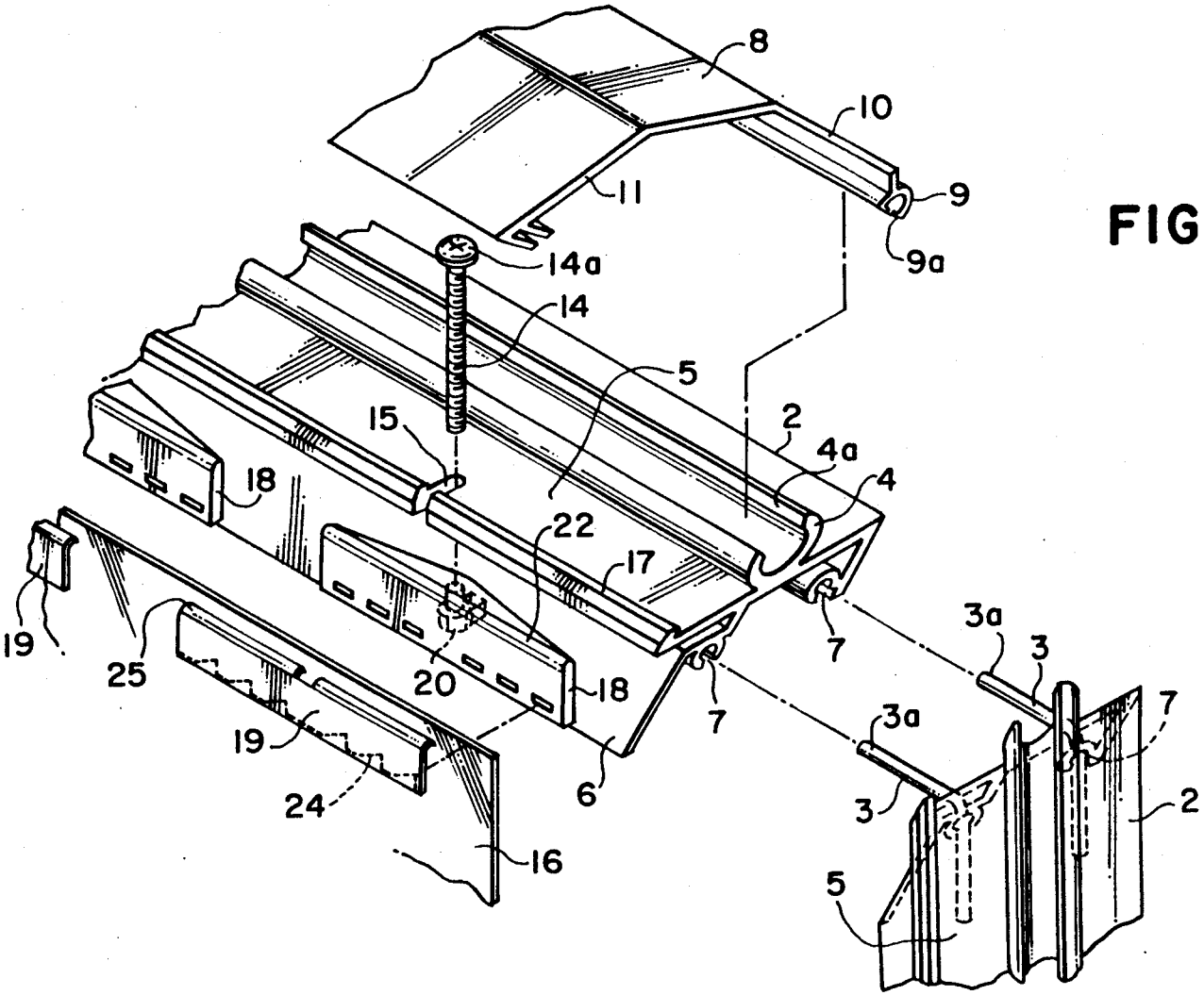
Figure 6:
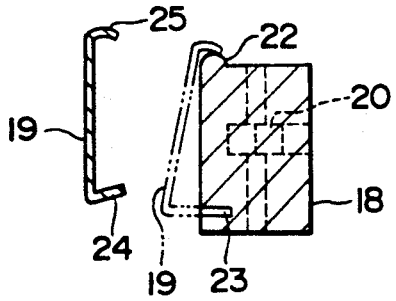
Figure 7:
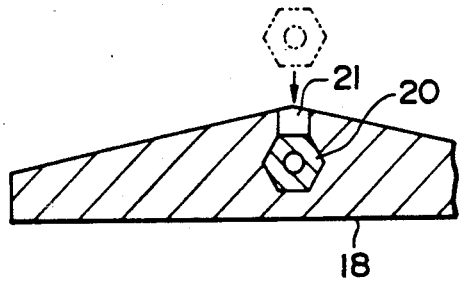

The present invention will be described in detail hereinunder with reference to the accompanying drawings.

A bulletin device $A_1$ according to a first embodiment of the invention illustrated in FIGS. 1 to 7 is a general, laterally long one-side bulletin type. A device frame 1 comprises edge rods 2 formed by the extrusion of a synthetic resin or a light-weight metal such as aluminum and subsequent cutting into lengths corresponding to the side lengths of the bulletin device, and generally L-shaped connectors 3 each connecting adjacent ends of adjacent edge rods 2.

The edge rods 2 each include in a cross-sectional shape thereof a generally C-shaped bearing portion 4 having an outward opening 4*a;* a horizontal mounting portion overhanging to the front side from the inside of the bearing portion 4; a vertical portion 6 extending inwards from near the base part of the horizontal mounting portion 5; a fitting portion 7 formed in an intermediate position of the vertical portion 6; and a fitting portion 7 formed behind and in opposed relation to the said fitting portion 7. Above the outer surface of the horizontal mounting portion 5 in front of the bearing portion 4 there is formed an operating space S for a bolt.

The connectors 3, formed in a generally L shape using aluminum or a synthetic resin, are each provided with plug portions 3*a*, 3*a* extending at an angle of 90°, the plug portions 3*a*, 3*a* being inserted into the fitting portions 7, 7 formed in end portions of the edge rods 2 adjacent to each other, whereby the edge rods 2 are connected together at an angle of 90°. Consequently, the connections of the edge rods 2 are at an angle of 90° without disorder.

A shaft portion 9 formed at the base end of each parting portion 8 is pivotally mounted in the bearing portion 4 formed on the outer periphery of the device frame 1 so that the parting portion 8 is pivotable between a parting state and an unparting state. In the parting state the horizontal mounting portion 5 is hidden and the operating space S is covered by the parting portion 8.

The parting portion 8, which is formed by the extrusion of a synthetic resin or aluminum, comprises in a cross-sectional shape thereof the shaft portion 9 formed on the outer back side, a horizontal portion 10 formed in front of the shaft portion 9, and a parting surface portion 11 extending inwards from the front edge of the horizontal portion 10 until its inner edge reaches a position inside the horizontal mounting portion 5 of the edge rod 2. The shaft portion 9 in the parting portion 8 has a generally large semicircular section in which a plane part 9*a* of a diameter smaller than the width of the opening 4*a* is formed inside the shaft surface. When the parting portion 8 has been pivotally moved into an unparting state, the plane portion 9*a* of a smaller diameter is opposed to the opening 4*a*, thus permitting the parting portion 8 to be removed from the bearing portion 4.

The shaft portion 9 can be fixed in a parting state to the bearing portion 4 with bolts 12. By removing the bolts 12 the parting portion 8 can be pivotally moved into an unparting state and can be removed from the bearing portion 4.

Inside the horizontal mounting portion 5 a suitable number of retaining means 13 are mounted at approximately equal intervals each by inserting a bolt 14 which is threadedly engaged with the retaining means 13 removably from the front side into a nearly cutout slot 15. The retaining means 13 can be moved inwards and outwards by turning a bolt head 14*a* on the outer surface side of the mounting portion 5 in the operating space S, whereby a bulletin 16 which is in a connected state to the retaining means 13 can be adjusted its stretching degree and also can be removed to the front from the horizontal mounting portion 5. Further, a protuberant portion 17 is projecting from the front edge of the outer surface of the horizontal mounting portion 5, whereby even when the bolt head 14*a* moves to the front side, this movement is prevented by the protuberant portion 17 so is not disengaged therefrom. Thus, the bulletin 16 is kept suspended unless the bolt head is caused to get over the protuberant portion 17 artificially.

The retaining means 13 each comprises a retaining member 18 formed of a synthetic resin and a metallic retaining plate 19. The retaining member 18 is integrally provided with a nut 20 for engagement with the bolt 14, the nut 20 being embedded or press-fitted from a window hole 21 formed on the rear side as illustrated. Further, a semicircular protuberant portion 22 is formed along the front edge of the upper surface, while horizontal retaining holes 23 are formed along the lower edge of the front face.

The retaining plate 19, which is a metallic plate having a spring force, is provided at the upper edge thereof with an engaging flange 24 projecting semiarcuately beyond the protuberant portion 22 into engagement with the same portion, and is also provided at the lower edge thereof with retaining pawls 25 projecting somewhat outwards (10°) with respect to a horizontal state so as to be engageable with the retaining holes 23.

The engaging flange 24 is brought into engagement with the protuberant portion 22 from the front side of an edge portion of the bulletin 16 with the retaining member 18 put on the rear side of the bulletin. In this state the retaining pawls 25 are pierced through the bulletin 16 and retained by the retaining holes 23, whereby the bulletin 16 is integrally connected with the retaining plate 19 and the retaining member 18. The retaining means 13 can be disengaged from the bulletin 16 by removing the retaining plate 19 and then can be connected to another bulletin 16.

In a connected state of a suitable number of retaining means 13 to the peripheral edge of the bulletin 16, the parting portion 8 is opened or removed and the bolt 14 is inserted from the front side into a nearby cutout slot 15 of the horizontal mounting portion 5 which has appeared to the front side, then by turning the bolt head **14*a* the bulletin 16 connected to the retaining means 13 can be suspended in a stretched state. Mounting and replacement of the bulletin from the front side of the device frame 1** are possible.

More specifically, the bulletin 16 can be mounted from the front side by merely applying the retaining member 18 to the rear side of the bulletin 16 and pushing the retaining plate 19 against the bulletin from the front side to sandwich the bulletin therebetween. Further, the bulletin 16 can be removed by merely pulling out the retaining pawls 24 of the retaining plate 19 from the bulletin. Thus, the mounting and removing work efficiency is high.

In the connected state of the bulletin 16 and the retaining means 13, moreover, the retaining flange 25 gets over the protuberant portion 22 and retains the same portion resiliently, and the retaining pawls 24 are held in a horizontal posture, not in the original outwardly facing posture thereof, within the retaining holes 23, so that a repulsive force is created at the retaining pawls 24. Under the action of this repulsive force, the retaining pawls 24 are retained in the retaining holes 23 and the engagement of the retaining flange with the protuberant portion 22 is maintained. Consequently, there can be attained a good connection of the retaining means with the bulletin 16.

Figure 8:
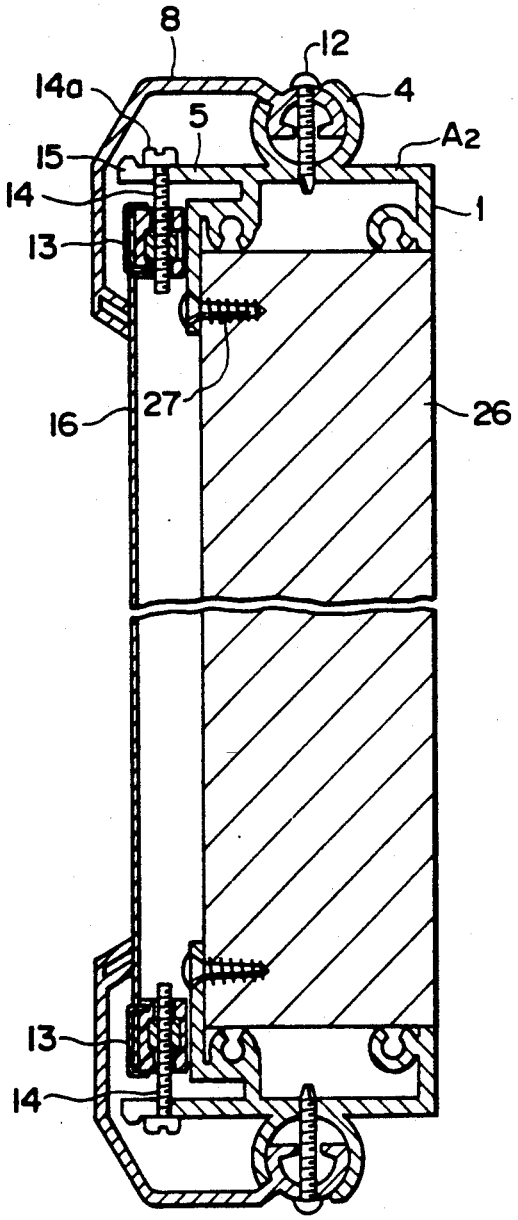
FIG. 8 is an enlarged vertical sectional view of a device according to a second embodiment of the present invention.

Referring now to FIG. 8, there is illustrated a bulletin device $A_2$ according to a second embodiment of the present invention, in which a back plate 26 is mounted with machine screws 27 behind the bulletin 16 in the device frame 1. Other constructional points are basically the same as in the first embodiment shown in FIG. 1, so will not be explained here.

Figure 9:
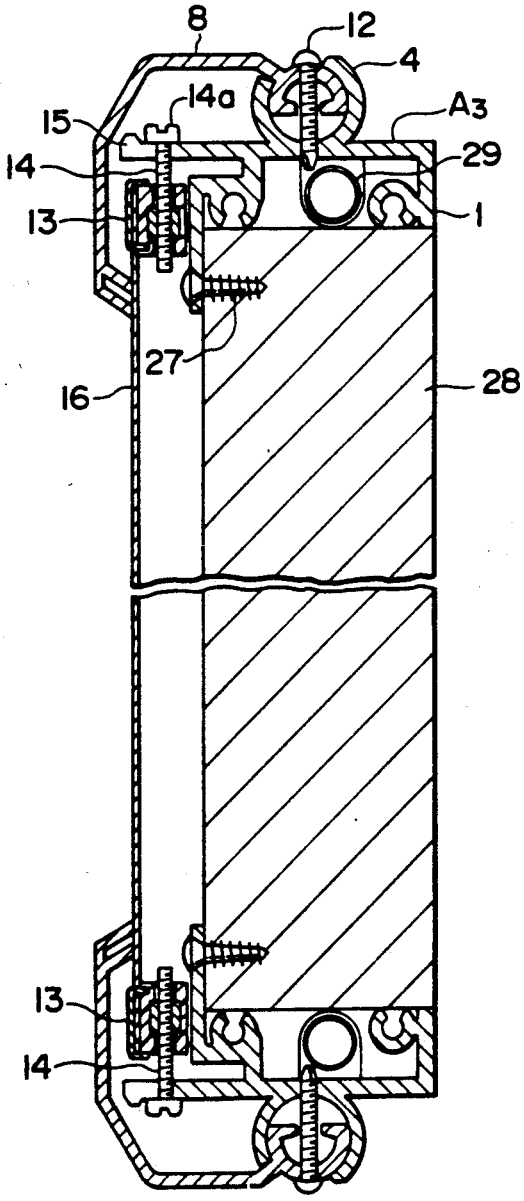
FIG. 9 is an enlarged vertical sectional view of a bulletin device according to a third embodiment of the present invention.

Referring to FIG. 9, there is illustrated a bulletin device $A_2$ according to a third embodiment of the present invention, in which in place of the back plate 26, a light transmitting plate 28 is mounted with machine screws 27, and a light source 29 is provided inside the device frame 1. Other constructional points are the same as in the first embodiment shown in FIG. 1, so will not be explained here.

Figure 10:
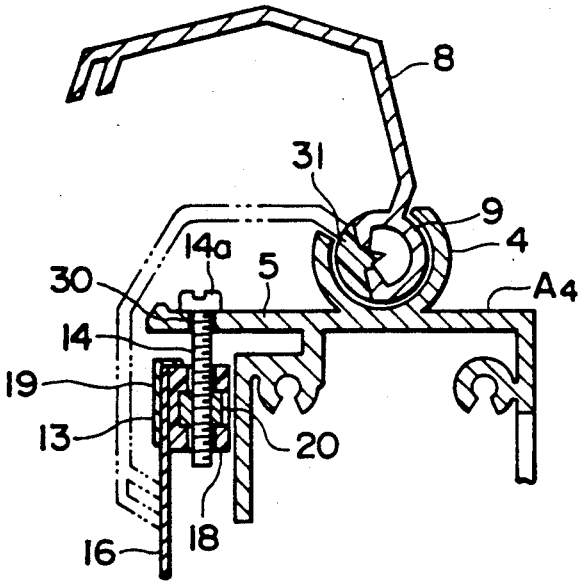
FIG. 10 is a partial enlarged sectional view of a bulletin device according to a fourth embodiment of the present invention.

Referring to FIG. 10, there is illustrated a bulletin device $A_4$ according to a fourth embodiment of the present invention, in which a through-hole 30 is formed in place of the cutout slot 15 and the bolt 14 is inserted through the through-hole 30 for removable threaded engagement with the retaining means 13, further, an abutment member 31 having a generally small semicircular section is contacted with the plane part **9*a* of a small diameter at the shaft 9 of the parting portion 8, whereby the parting portion 8 cannot be removed from the device frame 1. Other constructional points are basically the same as in the first embodiment illustrated in FIG. 1, so the explanation thereof will be omitted. In this fourth embodiment, the mounting or replacement of the bulletin 16 is performed in an opened state of the parting portion 8**.

Figure 11:
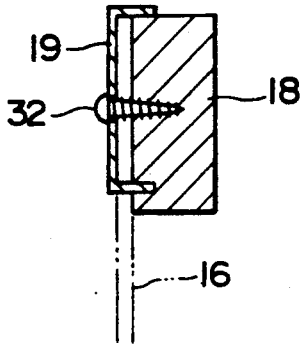
FIG. 11 is a vertical sectional view showing another example of a retaining means.
Figure 12:
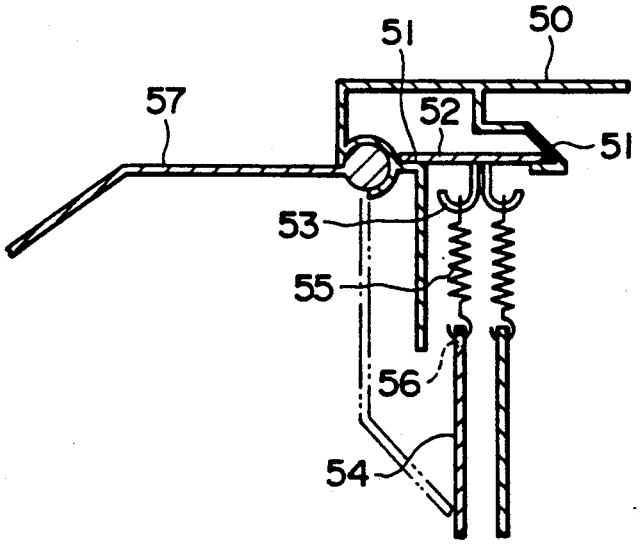
FIG. 12 is a partial enlarged sectional view showing a conventional example.

Although the bulletin devices of the above embodiments are of a one-side bulletin type, the present invention is not limited thereof. The bulletin device to which the present invention is applied may be a double-side bulletin type. In the retaining means 13, moreover, the retaining plate 19 may be mounted with bolts 32 to the retaining member 18 (see FIG. 11).

What is claimed is:

1. In a bulletin device having a device frame with a parting portion which constitutes a front face of the device frame and a horizontal mounting portion hidden behind a rear side of said parting portion, said parting portion being formed for opening and closing motion, a bulletin suspending mechanism for suspending a bulletin in a tensed state in the bulletin device, comprising:

a suitable number of retaining means mounted inside the horizontal mounting portion for holding said bulletin, each of said retaining means comprising a retaining member having a front side and a retaining plate positioned on the front side of the respective retaining member, each said retaining member having a protuberant portion along a front edge of an outer surface thereof and also having retaining holes along an inner edge of a front face thereof, each said retaining plate having a semiarcuate engaging flange formed at an outer edge thereof and engaging said protruberant portion of one said retaining member in its assembled position, each said retaining plate also having retaining pawls formed at an inner edge thereof so that the retaining pawls pierce the bulletin and come into engagement with said retaining holes, and the bulletin is sandwiched removably between said retaining member and said retaining plate in said assembled position; and bolt means for mounting each of said retaining means inside the horizontal mounting portion so that each said retaining means is adjustable for inward and outward movement, the bolt means including a bolt head mounted outside of said horizontal mounting portion, and the bulletin being connected to said retaining means and suspended in a tensed state within the device frame by turning the head of said bolt means positioned outside said horizontal mounting portion.

2. A bulletin suspending mechanism in a bulletin device according to claim 1, wherein said bolt means is mounted removably in a front and rear direction with respect to a cutout slot formed in a front edge of said horizontal mounting portion.

3. A bulletin suspending mechanism in a bulletin device according to claim 2, further including a protuberant portion along the front edge of an outer surface of said horizontal mounting portion.

4. A bulletin suspending mechanism in a bulletin device according to claim 1, wherein said bolt means can b inspected and removed inwards and outwards with respect to a through-hole formed in said horizontal mounting portion.

5. A bulletin suspending mechanism in a bulletin device according to claim 1, wherein said retaining pawls are somewhat inclined outwards with respect to a horizontal state.

* * * * *